United States Patent [19]

Vits

[11] Patent Number: 4,843,731

[45] Date of Patent: Jul. 4, 1989

[54] DEVICE FOR FLOATABLY GUIDING WEBS OF MATERIAL BY MEANS OF A GASEOUS OR LIQUID MEDIUM

[76] Inventor: Hilmar Vits, Hüschelrath 16, D-5653 Leichlingen 1, Fed. Rep. of Germany

[21] Appl. No.: 22,778

[22] Filed: Mar. 6, 1987

[30] Foreign Application Priority Data

Mar. 6, 1986 [DE] Fed. Rep. of Germany ..... 3607371

[51] Int. Cl.[4] ..... F26B 13/00

[52] U.S. Cl. ..... 34/10; 34/156; 226/97

[58] Field of Search ..... 34/156, 160, 10, 48; 226/97, 7

[56] References Cited

U.S. PATENT DOCUMENTS

| | | | |
|---|---|---|---|
| 2,144,919 | 1/1939 | Gautreau | 34/48 |
| 3,957,187 | 5/1976 | Puigrodon | 226/7 |
| 3,999,696 | 12/1976 | Reba et al. | 226/97 |
| 4,055,003 | 10/1977 | Sack | 34/156 |

FOREIGN PATENT DOCUMENTS

| | | |
|---|---|---|
| 1474239 | 10/1979 | Fed. Rep. of Germany . |
| 3318861 | 11/1984 | Fed. Rep. of Germany . |
| 2547803 | 10/1983 | France . |
| 2141989 | 12/1986 | United Kingdom . |

*Primary Examiner*—Henry A. Bennet
*Attorney, Agent, or Firm*—Michael L. Dunn

[57] ABSTRACT

The invention relates to a device for floatably guiding webs of material by means of a gaseous or liquid medium. The device comprises one or more elongate flow elements having a surface which is arched more particularly convexly to the web of material which are disposed in succession in the direction of travel of the web and transversely thereof, and nozzles so disposed in rows at a distance from such surface that the free jets emerging from the nozzles blow on the surface of the flow member at a shallow approach flow angle and are converted on the surface into wall jets, before they blow on the web of material, more particularly by reversal of flow. More particularly nozzles associated with both longitudinal edges of each flow member and delivering free jets directed towards one another produce on contrast with conventional devices, which operate on the supporting surface or air cushion principle, improved supporting behavior with a strongly progressive characteristic in the proximal zone of the web of material and a relatively steep entry into the zero value of the supporting force.

23 Claims, 4 Drawing Sheets

Figure 1:
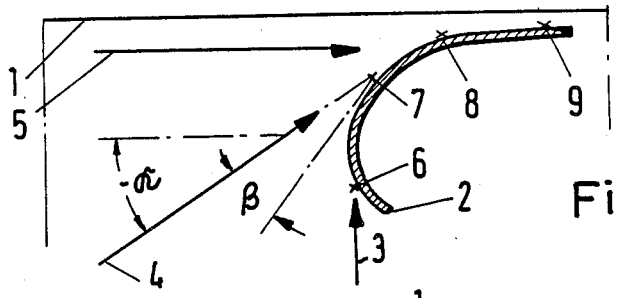

DEVICE FOR FLOATABLY GUIDING WEBS OF MATERIAL BY MEANS OF A GASEOUS OR LIQUID MEDIUM

The invention relates to a device for floatably guiding webs of material, comprising an elongate flow member and disposed at right angles to the moving direction of the web and having a surface curved convexly on the web side, and nozzles which are disposed in rows on at least one of the two longitudinal edges of the flow member and by means of which a gaseous or liquid medium can be blown in between the flow member and the web.

The floatable guiding of webs of material, for example, coated papers webs or impregnated or otherwise coated webs is often combined with a thermal treatment, for example, the drying of web. The web passes through chambers of large capacity in which considerably masses of air are circulated. Only a small proportion of the masses of air is removed as outgoing air and replaced by fresh air. The heat to be supplied for drying the web is transmitted by the heated blown air emerging from the nozzles. The blown air to be heated is taken from the atmosphere of the drier and heated by heating devices, for example, heat exchangers.

In order to enable the web of material to be floatably guided, while the heat required for drying is transmitted to the web, the nozzles have a cross-section about to 5%, related to the surface of the web of material acted upon, in dependence on the operational principle of the device (supporting surface or air cushion principle). This large volume of air which is blown in via the nozzles is disadvantageous in a number of respects:

1. The large volume of air for the nozzles means that all the parts required for transport and heating for example blower, heat exchanger, air cleaning means must be correspondingly large. Due to the large volume of the drier, therefore, companies decline to integrate a drier, for example, in a paper-making machine.
2. It is known that a combination of gas-heated infrared radiators and blown-air-feed devices for floatably guiding webs of material can achieve high drying performances and improve drying qualities, if the infrared radiators and the devices for floatably guiding the web succeed one another at a short distance. Nevertheless, a drier of this kind has not been widely adopted, since the blown air flow of conventional devices disturbed the operation of the infrared gas radiators.
3. Since the blown air emerging from the nozzles and acting upon the web of material is taken from the atmosphere of the drier, it inevitably contains small foreign bodies, since even filter and their sealing have deficiencies, so that the deposit of small particles on inaccessible places cannot be avoided. If the blown air impinged uncleaned on the frequently sticky web of material, the particles would stick thereto and form surface faults. Due to the large volume of air, even imperfect cleaning is correspondingly expensive.

A further disadvantage of the device for the floatable guiding of webs of material is that their supporting force behaviour is not optimum.

It is true that as the distance from the web of material becomes smaller, a device operating on the air cushion principle has a progressive supporting force behaviour, but the supporting force curve plotted over the distance from the web of material passes to zero only with a relatively large distance. This means that with such a device the web of material cannot obtain a stable floatable position. Devices of this kind are therefore suitable only if corresponding devices are disposed on both sides of the web of material and offset to each other.

It is true that a device operating on the airfoil principle ensures a stable floating position of the web, since the supporting force curve reaches the zero value of the supporting force with some steepness, but the absolute value of the supporting force is low, even with a small distance from the web, in comparison with a device operating on the air cushion principle.

A known device of the initially mentioned type operating on the airfoil principle includes nozzles for the blown air in the form of slots or holes, which are disposed remote from the convexly curved surface of the flow member. The blowing air of the nozzles is directed at an acute angle towards the web and is diverted by the web into the channel formed by the web and the flow member. The negative pressure in the channel is reduced by air sucked into the channel through holes in the flow member, so that the pressure cannot exceed a level which is critical for the supporting force (DE No. 14 74 239 C3).

It is an object of the invention to provide a device for floatably guiding webs of material whose supporting force behaviour is improved in comparison with conventional devices, with a lower volume of liquid or gaseous medium to be supplied to the nozzles.

This problem is solved in a device of the kind specified by the features that the nozzles take the form of free jet nozzles which are so directed at an acute approach flow angle and shallowly at the surface of the flow members that the jets emerging as free jets from the nozzles blow on the web of material only after they have impinged on the surface of the flow member and been converted into wall jets on such surface.

In comparison with conventional devices, the device according to the invention requires a several times smaller volume of gaseous or liquid medium for the nozzles. The cross-section of the nozzles can be reduced by a factor of 10 to 100- i.e., to 1 to 0.1 o/oo related to the surface of the web of material acted upon, combined with an appreciably improved supporting behaviour, but with such small nozzle cross-sections the pressure of the medium must be increased correspondingly. Due to the high flow velocity of the free jets, by the injector principle air from the surroundings is admixed with the free jets, and after impingement on the surface of the flow member with the wall jets. In contrast, with conventional devices, in which the flow jets already emerge as wall jets from the nozzles at a comparatively lower velocity, but in a larger volume, practically no air becomes admixed from the surrounding atmosphere. The heavy-loss energy conversion (reduction of the flow velocity) of the gaseous or liquid medium takes place due to mixing in the device according to the invention is at any rate negligible if heat transfer is preformed not via the medium, but via specially provided heating systems.

Due to the small volume of blown jets emerging at high flow velocity from the nozzles the device according to the invention can also be used in a drier as a barrier sluice at the inlet slot for the web of material. In that case the device is operated with highly heated blown air. By mixing it with the cold air flowing in via the inlet slot, the blown air is heated to a temperature at which mixing with the solvent-containing drier atmosphere can no longer cause harmful condensations.

The use of devices according to the invention enables the volume of the drier and the parts sharing in the preparation of the air to be supplied to the nozzle to be reduced to one fifth of their previous size.

The device according to the invention can be operated on both the airfoil and also the air cushion principle, in dependence on whether the nozzles are provided on only one longitudinal edge of on both longitudinal edges. Due to the appreciably better supporting force behaviour, a device having nozzles disposed on both edges is preferred. The supporting force behaviour can be further improved if the angle of attack, enclosed by the web of material and the free jets, of the nozzles of one row differs from that of the other row.

If the device is constructed with at least one convexly curved surface at the edge, the nozzles should be so directed that their free jets impinge on that part of the surface, thereby rendering possible a better widening-out of the jets and a better conversion into wall jets.

It has been found advantageous if the sum of the approach flow angle and of the angle of attack enclosed by the web of material and the free jets lies between 5° and 60°, preferably 15° and 35°. The angles should be as small as possible.

According to a further feature of the invention, the axis of the free jets of each nozzle forms a secant, tangent or passant to the curved surface of the flow member, and the distance of the nozzle from the surface of the flow member, taking into account the angle of divergence of the free jet is such that in the absence of the web of material the free jet impinges over at least one third of its periphery on the surface of the flow member.

The distance between the nozzles and the flowed-on surface of the flow member amounts preferably to about 1/10, more particularly 1/5 of the length of the surface of the flow member in the direction of flow turned towards the web.

The convexly curved surface of the flow member can have different shapes. The shape of a shallow arc of an ellipse, a shallow compound curve or a shallow polygon have proved advantageous.

With a number of flow members disposed in rows in the direction of travel of the web, a common supply duct for the gaseous or liquid medium for the nozzles associated with the two flow members is provided between two adjacent flow members. The succession of device according to the invention is particularly close if with a number of flow members disposed in rows in the direction of travel of web, the flow members take the form if supply ducts for the gaseous or liquid medium and carry the nozzles which are associated with the adjacent flow members.

If two rows of nozzles are associated with each flow member —i.e., the device operates on the air cushion principle —only a little air flows from the zone of each device, since during the reverse flow above the surface, passing over the web of material, the free jets absorb air by the injector principle from such reverse flow and feed it back into the zone between the web of material and the surface of the device. Only a small proportion can flow away. To even out such discharge, according to a possible feature of the invention a discharge duct is provided between the nozzles and the flow member on the side remote from the web of material. In that case the air can flow between the free jets into such duct and from there into a collecting duct, which can be formed by the flow member.

The advantage that the device according to the invention can manage with a small volume of air, because the majority of the air flowing back from the cushion between the web of material and the flow member is readmixed with the free jets, is faced by the disadvantage that the degree of heat-transition between the blowing medium and the web is smaller in comparison with common devices using a greater volume of medium because of the less friction on the surface. This disadvantage may more than compensated without negative affect to the free jets if the devices are operated in combination with heating members, more particularly gas-heated infrared bright radiators. However, cooling members can be provided instead of heating members.

According to a further feature of the invention, therefore, the flow member of a member disposed beside the flow member is constructed in the form of a heating or cooling member. The heating or cooling member can have a chamber to which a heating or cooling medium can be supplied. More particularly, the heating member can take the form of an infrared obscure radiator. The heating medium can be, for example, heating oil.

Preferably the heating member takes the form of a gas-heated infrared bright radiator. It can be disposed immediately adjacent the device. Preferably, with a number of floatable guiding devices disposed in succession in the direction of travel of the web, they can alternate with heating or cooling members in close succession.

The invention also relates to a method of operating a drier having a number of devices according to the invention for floatably guiding a web of material, disposed more particularly on both sides thereof, and heating members associated with such devices. The method according to the invention is characterized in that fresh air is supplied to the nozzles at elevated pressure and in a volume such as is necessary to absorb the volatile substances given off by the web of material during drying. This method step gives a number of advantages. The fresh air to be supplied to the nozzles merely takes the place of the outgoing air removed from the drier. The energy balance is favourable, since only that volume of fresh air to be heated is supplied which is required by the drying process. This small volume is not disadvantage to the floatable guiding of the web, since the low volume is compensated by the high flow velocity of the free jet emerging from the nozzles.

Figure 6A:
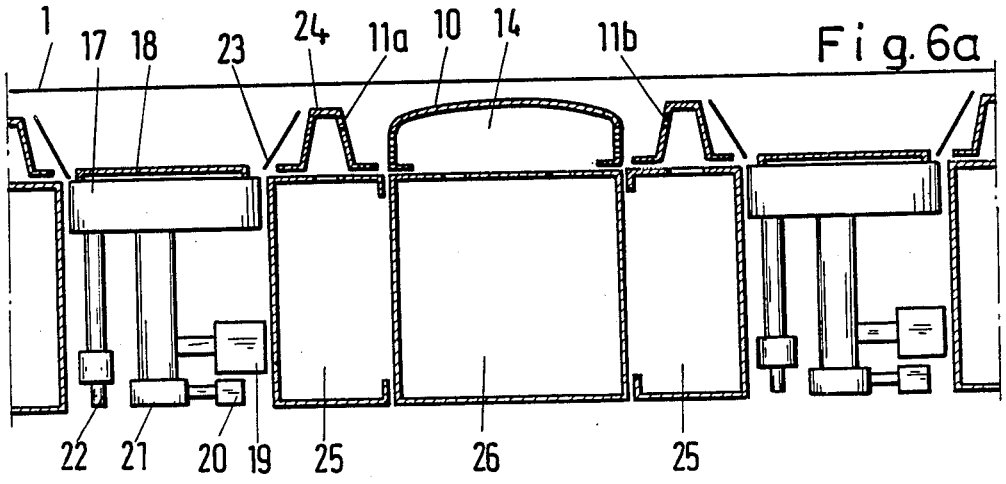
Figure 7A:
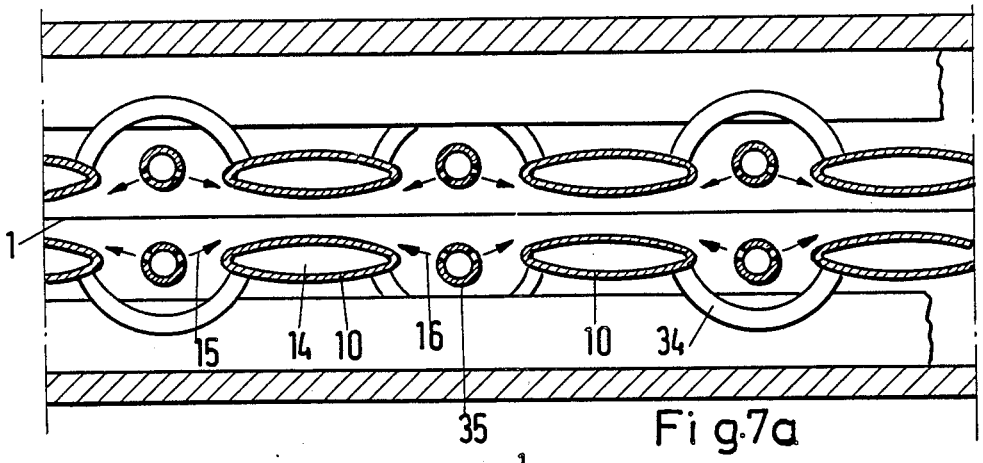
Figure 7B:
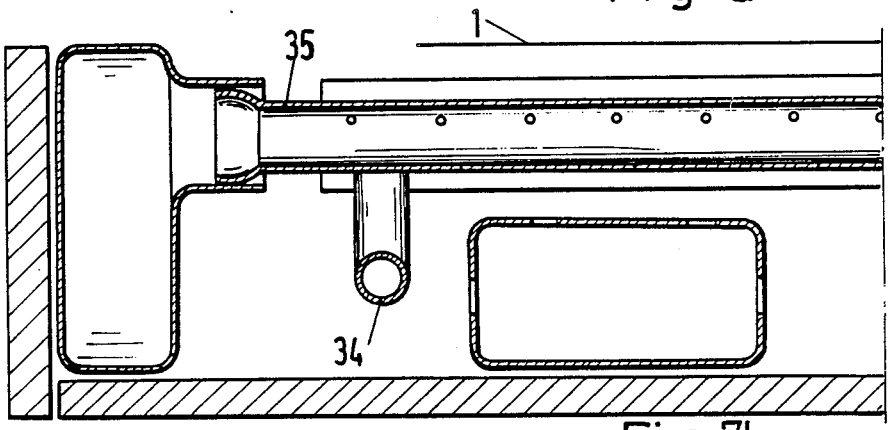
Figure 7C:
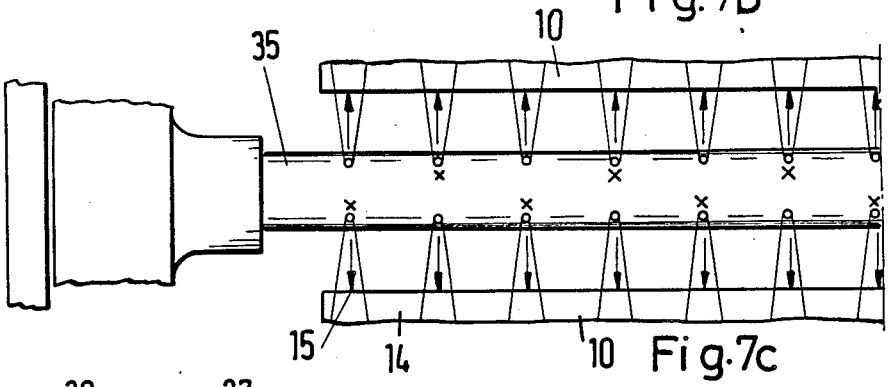
Figure 7D:
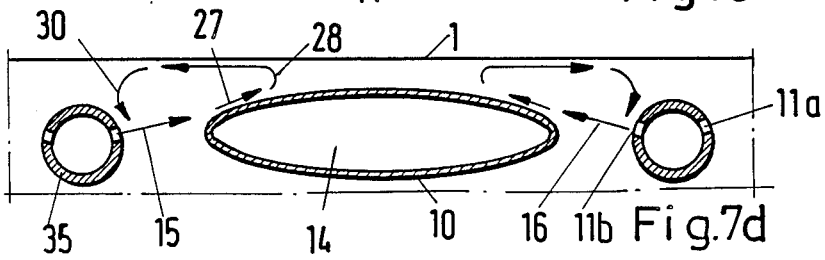
Figure 8:
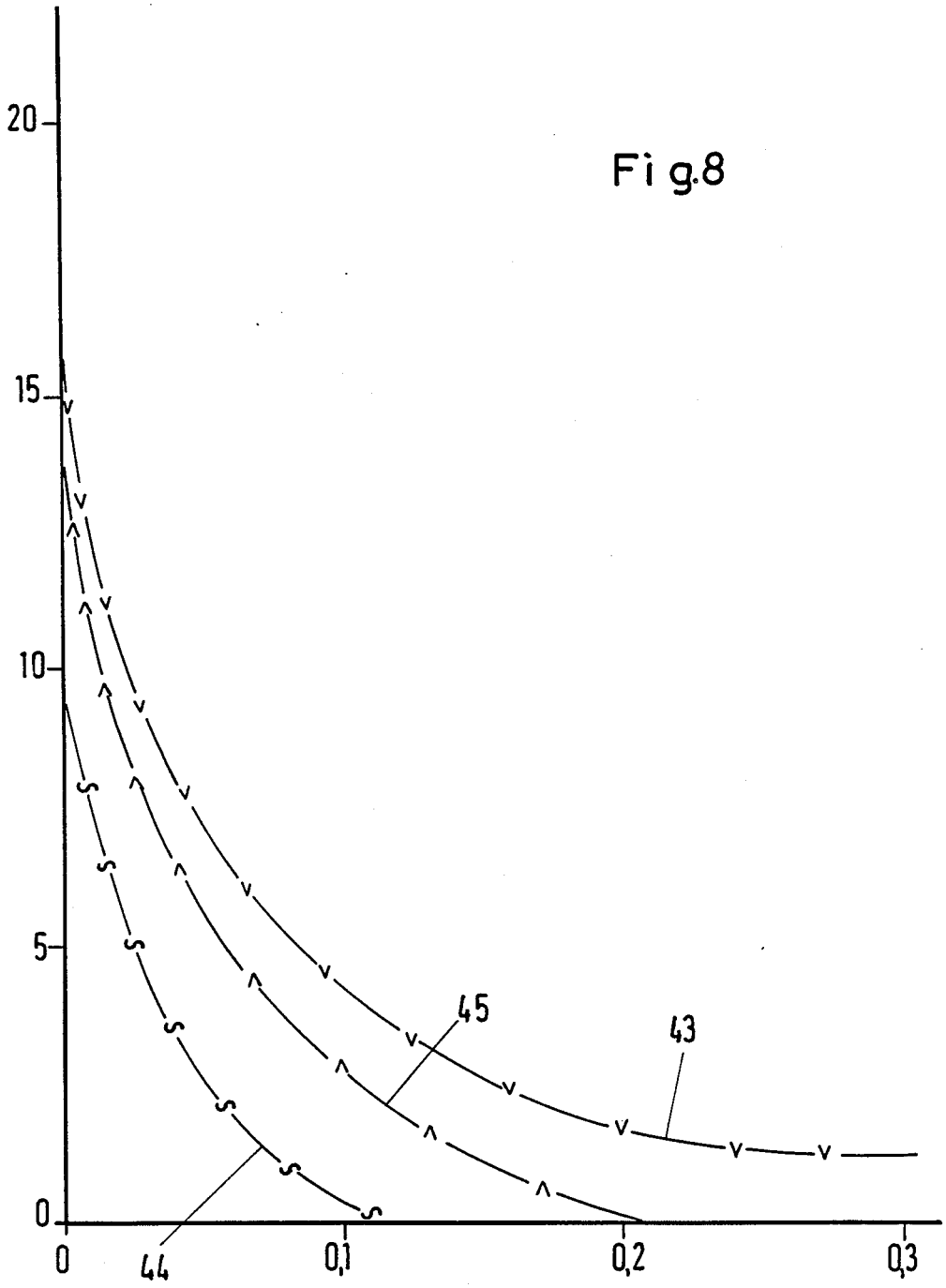

An embodiment of the invention will now be described in detail with reference to the drawings, wherein:

FIG. 1 shows diagramatically in cross-section in the direction of travel of a web of material a longitudinal edge of a flow member of a device for floatably guiding such webs, FIGS. *2a–5b* show diagramatically in cross-section in the direction of travel of a web of material devices and flow members of devices for floatably guiding such webs, known devices being shown on the left and corresponding flow members of devices according to the invention being shown on the right, FIG. *6a* shows in cross-section in the direction of travel of a web of material devices according to the invention alternating with gas-heated infrared bright radiators, FIG. *6b* is an enlarged detail of the device according to the invention illustrated in FIG. 6a, FIG. 7*a* shows devices according to the invention for floatably guiding a web of material disposed on both sides thereof, with flow members constructed as heating members, FIG. 7*b* shows in cross-section and in enlarged ¼ quadrant representation a device illustrated in FIG. 7*a*, FIG. 7*c* shows the device illustrated in FIG. 7*a* in an enlarged detail and in a plan view of two adjacent rows of nozzles, FIG. 7*d* shows a device illustrated in FIG. 7*a* in cross-section in the direction of travel of a web of material, the flow being shown diagramatically, and FIG. 8 is a graph of the supporting force behaviour of different devices for floatably guiding webs of material.

FIG. 1 shows the various possible ways by which flow jets 3, 4, 5 emerging as free jets from nozzles blow on a convexly curved flow member 2. In any case the flow jet 3, 4, 5 impinges on the convexly curved surface at a shallow approach flow angle and is converted into a wall jet, using the coanda effect.

The jet 3 is directed perpendicular, the jet 4 inclined at an angle $\alpha$ and the jet 5 parallel to a web of material. The arrows diagramatically showing the central axes of the jets 3, 4, 5 impinge on the curved surface of the flow member 2 at points 6, 7, 8. Due to the coanda effect they are guided along this surface and at point 9 reach a predetermined strength, which is typical of each device, but with the difference in the device according to the invention that the effect is achieved with a quantity of air, reduced to a fraction, of a predetermined densifying energy.

These effects can be obtained with different flow members. FIGS. 2*b*, 3b, 4b, 5b illustrate characteristic examples. Of these examples the best effects are achieved with the example illustrated in FIG. 5*b*.

The associated conventional devices are shown on the left alongside the examples in FIGS. 2*b* to 5*b*. The devices 2*a*, 4*a*, 5*a* operate on the air cushion principle, while the device illustrated in FIG. 3*a* operates on the airfoil principle. FIG. 8 shows characteristic curves for the supporting force over the distance between the web of material and the flow member surface for these known devices and the devices according to the invention for floatably guiding webs of material. To obtain a true comparison between the different devices, dimensionless distance values have been selected for the abscissa and dimensionless supporting force values for the ordinate. The dimensionless distance is the ratio between the absolute distance and the extension of the flow member in the direction of travel of the web. The dimensionless supporting force is the ratio between the absolute supporting force and the product of the initial dynamic pressure and the cross-section of the nozzles, taking contraction into account.

Figure 2A:
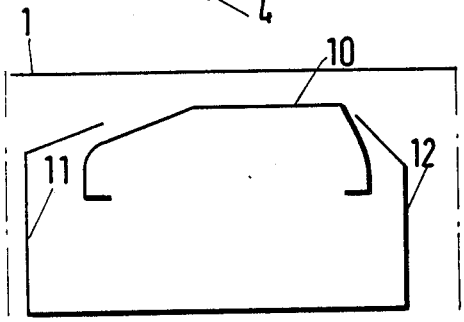
Figure 4A:
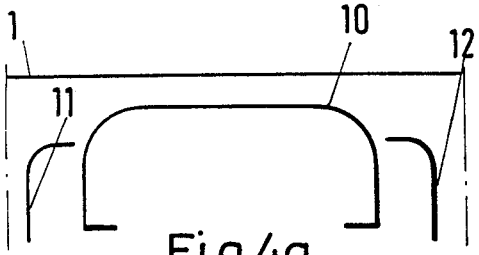
Figure 5A:
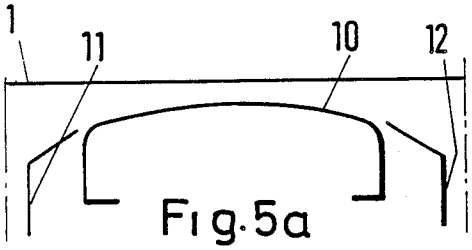

Curve 43 represents the supporting force behaviour of devices operating by the air cushion principle - i.e., the behaviour of the devices illustrated in FIGS. 2*a*,-4*a*,5*a*. It is true that the supporting force of such a device increases steeply at a relatively high level when the distance of the web moves to zero, but with increasing distance of the web the supporting force moves only very gradually towards zero. This means that no stable floatable position can be obtained with such devices. As a result such devices are suitable for guiding webs of material only if they are disposed on both sides of the web and are as far as possible also disposed against one another so as to guide the web in an undulating movement.

Figure 3A:
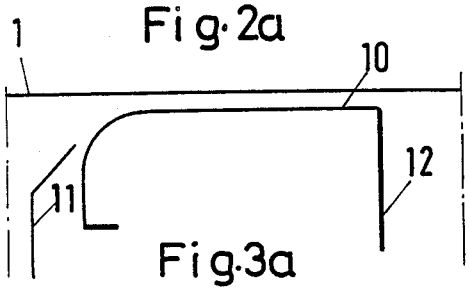
Figure 3B:
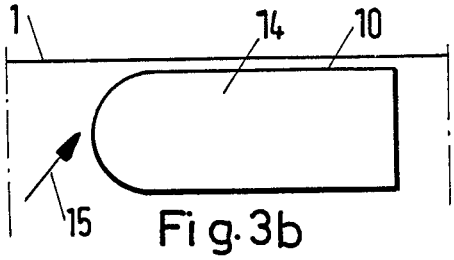

Curve 44 shows the supporting force behaviour of the device operating by the airfoil principle according to example of FIG. 3*a*. It is true that with such a device the supporting force curve passes with some steepness into the supporting force zero value, so that a stable floatable position can be obtained to that extent, but the level of the supporting force as a whole is low.

In contrast, the supporting force behaviour of the device according to the invention is appreciably better.

Figure 5B:
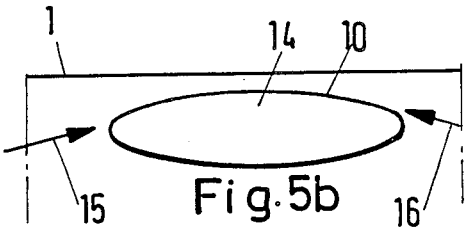

Curve 45 shows the supporting force behaviour of the device according to the embodiment shown in FIG. 5*b*. Although the volume of air required is only a fraction of that of conventional devices operating by the air cushion principle, the device according to the invention obtains substantially the completely satisfactory supporting force behaviour of the conventional devices operating by the air cushion principle, but in contrast with these conventional devices the supporting force curve passes with some steepness into the supporting force zero value. Improved supporting force behaviour as a whole is therefore produced by the device according to the invention.

Figure 2B:
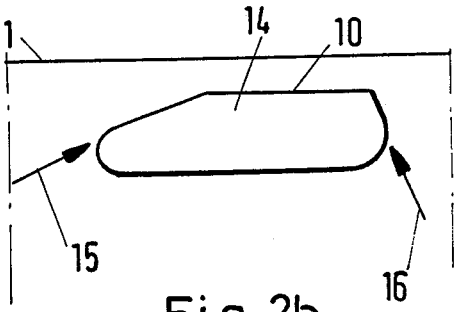
Figure 4B:
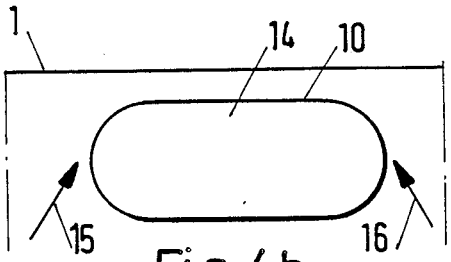

This also applies in principle to the two other devices shown in FIGS. 2*b* and 4*b*, which operate on the air cushion principle, too.

Figure 6B:
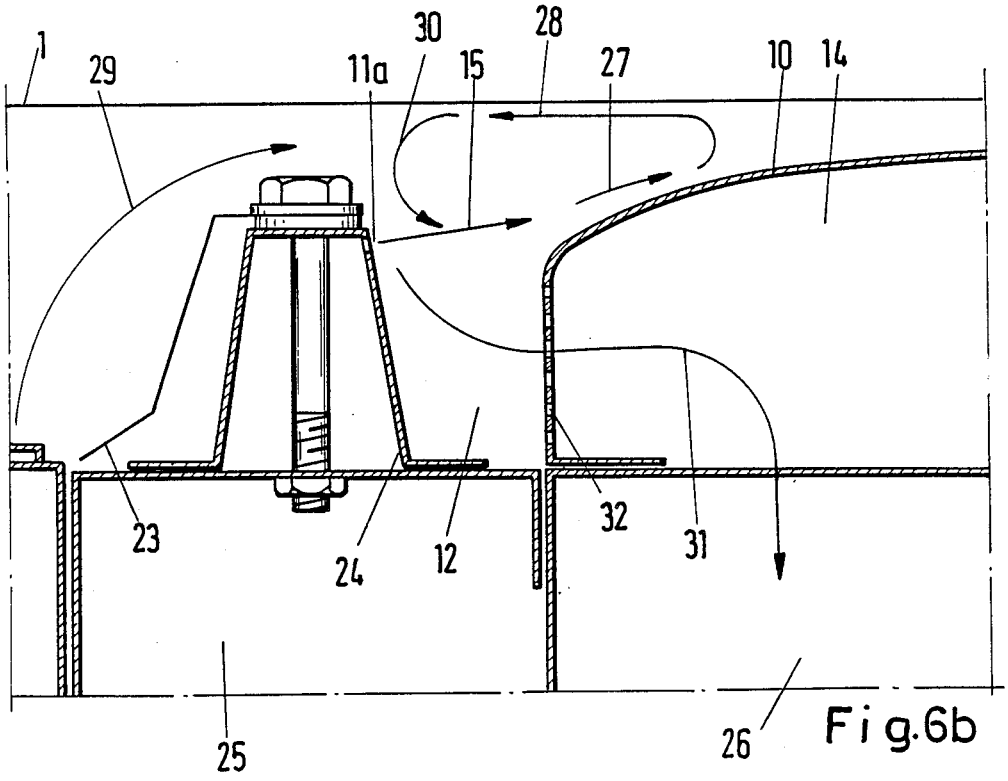

The construction and principle of operation of a device according to the invention will now be described in detail with reference to the embodiments shown in FIGS. 6a and 6b. A flow member 10 having a shallowly elleptical surface curved in relation to a web of material 1 is disposed between two nozzle boxes 24 in which small round holes having a cross-section of 1 $mm^2$ to 10 $mm^2$ and acting as nozzles 11*a*,11*b* are disposed in rows at a mutual distance of 10 mm to 40 mm. The distance of the nozzles 11*a*,11*b* from the flow member 10 amounts to about 1/10 or more of the width of the curved surface of the flow member 10. The box 24 is constructed as a distributing duct for the blown air to be supplied from a supply duct 25. The flow member 10 is constructed as a collecting duct 14 for the air to be conducted to a discharge duct 26. The air to be removed passes into a duct 12 disposed between the nozzle box 24 and the collecting duct 14 and from that place via a sieve 32 into the collecting duct. Blown jets 15, shown diagramatically by their jet axes, emerging as free jets at high flow velocity from the nozzles 11*a* impinge at an acute approach flow angle on the curved surface of the flow member 10, where they are converted into wall jets by the coanda effect following the curvature of the flow member 10. Since air is blown from both edges of the flow member 10 into the space between the web of material 1 and the curved surface of the flow member 10, the flow is reversed, passing in thin form along the web of material 1 and after a certain distance being again deflected as shown by arrow 30. Due to the injector action of the free jet 15, an appreciable volume of this deflected air is admixed with the flow jet 15. Only a small proportion passes between the free jets into the duct 12 via a sieve 32 into the collecting duct 14. The special effects as regards the supporting force behaviour of the device according to the invention in comparison with a device operating by the circulating air method—i.e., with an appreciably larger volume of air—consist in the features that the volume of the free jets 15 and of the air admixed by injector effect is relatively small. As a result, the energy losses of the free jets due to the admixture of air remain within economically reasonable limits. It is true that the progressive air cushion nevertheless operates, but this is very advantageous for the supporting force behaviour of a nozzle operating by the air cushion principle, since it results in a steeper characteristic. Due to the smaller volume of air, even during reverse flow a relatively thin layer of air is formed, which results in a quicker decrease in velocity. The damming and influencing of adjacent nozzles which usually takes place is therefore eliminated in the zone of the deflection 30 by the device according to the invention. This is a particularly important aspect if a gas-heated infrared bright radiator is provided on each side of the device for floatably guiding a web, as shown in the embodiment illustrated in FIGS. 6a and 6b. For the reasons stated, the flow of the device according to the invention does not influence the operation of the radiator negatively, but enables the flue gas flow 29 to be admixed with the flow of blown air.

In the embodiment shown in FIG. 6*a* a gas-heated infrared radiator is provided between adjacent supply ducts 25. The radiation surface 18 of radiator elements 17 is disposed parallel with the web of material 1 at a distance of about 50 mm. A supply pipe for the air of combustion is disposed on that side remote from the web of material which is accessible for servicing and maintenance. The corresponding supply pipe 20 for the gas is disposed alongside the first-mentioned supply pipe 19. Air and gas are supplied to a mixer 21. Elements 22 for the ignition and flame monitoring of the infrared radiators are also provided in the space between the ducts 25. A screening 23 of radiation-reflecting material protects the device for floatably guiding webs, more particularly the distributing ducts 24, against infrared radiation.

In the embodiment illustrated in FIGS. 7*a* to 7*d* devices for floatably guiding webs, as known basically from FIG. 5*b*, are disposed on both sides of the web. The flow member 10 comprises a tube 14. The tubes 14 are interconnected via bends 34. This coupling enables heating oil to be supplied to the tubular flow members 10. Due to this kind of heating, they act as infrared obscure radiators.

Disposed between each pair of flow members 10,14 is a nozzle tube 35 in which nozzles of circular cross-section are disposed in two rows as a distance from one another. Blown air in the form of free jets 15,16 emerges from the nozzles and flows onto the flow member 10,14 shallowly at an acute approach flow angle, so that a flow is formed, such as is represented by wall jets 27, reverse flow 28 and flow reversal 30 (Cf. FIG. 6*b*).

I claim:

1. A device for floatably guiding webs of material, comprising a plurality of elongate flow members, disposed at right angles to the moving direction of the web and spaced from each other and having a surface curved convexly on the web side, and individual nozzles which are disposed in rows and spaced from each other on at least one of the two longitudinal edges of the flow member and by means of which a gaseous or liquid medium can be blown in between the flow member and the web, characterized in that the nozzles take the form of free jet nozzles which are disposed at a distance from the flow members and are so directed at an acute approach flow angle and shallowly at the surface of the flow members that the jets emerging as free jets from the nozzles blow on the web of material only after they have impinged on the surface of the flow member and been converted into wall jets on such surface.

2. A device for floatably guiding webs of material, comprising a plurality of elongate flow members, disposed at right angles to the moving direction of the web and spaced from each other and having a surface curved convexly on the web side, and individual nozzles which are disposed in rows and spaced from each other on at least one of the two longitudinal edges of the flow member and by means of which a gaseous or liquid medium can be blown in between the flow member and the web, characterized in that the nozzles take the form of free jet nozzles which are disposed at a distance from the flow members and are so directed at an acute approach flow angle $\alpha$ enclosed by the web of material and the free jets of the nozzles of one row differs from that of the nozzles of the other row and the jets emerging as free jets from the nozzles blow on the web of material only after they have impinged on the surface of the flow member and been converted into wall jets on such surface.

3. A device according to claim 1 characterized in that at least one flow member is constructed in the form of a heating member.

4. A device according to claim 1 characterized in that with a flow member having a surface convexly curved at at least one edge, the jets of the nozzles are so directed that the free jets impinge on such part of the surface.

5. A device according to claim 2 characterized in that the sum of an approach flow angle $\beta$ of the free jets plus the angle $\alpha$ enclosed by the web of material and the free jets lies between about 5° and about 60°.

6. A device according to claim 4 characterized in that an axis of the free jets of each nozzle forms a secant, tangent or passant to the curved surface of the flow member and the distance of the nozzle from the surface of the flow member, taking into account the angle of divergence of the free jet is such that in the absence of the web of material the free jet impinges over at least about one third of its periphery on the surface of the flow member.

7. A device according to claim 1 characterized in that the distance of the nozzles from the flowed-on surface of the flow-member (10) amounts to between about 1/10 to about 1/5 of the length of the surface of the flow member in direction of flow turned towards the web.

8. A device according to claim 1, characterized in that with a number of flow members disposed in rows in the direction of travel of the web, a common supply duct for the gaseous or liquid medium for the nozzles associated with two flow members is provided between two adjacent flow members.

9. A device according to claim 1 characterized in that a discharge duct is provided between the nozzles and the flow member on the side remote from the web of material.

10. A device according to claim 3, characterized in that the heating member takes the form of an infrared obscure radiator.

11. A device according to claim 3, characterized in that the heating member takes the form of a gasheated infrared bright radiator.

12. A device according to claim 2 characterized in that the sum of an approach flow angle $\beta$ of the free jets plus the angle $\alpha$ enclosed by the web of material and the free jets lies between about 10° and about 30°

13. A device according to claim 4 characterized in that the convexly curved surface of the flow member has in cross-section the shape of a shallow arc of an ellipse.

14. A device according to claim 4 characterized in that the convexly curved surface of the flow member has in cross-section the shape of a shallow compound curve.

15. A device according to claim 4 characterized in that the convexly curved surface of the flow member has in cross-section the shape of a flat polygon.

16. A device according to claim 1 characterized in that at least one flow member is constructed in the form of a cooling member.

17. A device according to claim 3, characterized in that the heating member has a chamber to which a heating medium can be supplied.

18. A device according to claim 16, characterized in that the cooling member has a chamber to which a cooling medium can be supplied.

19. A device according to claim 3, characterized in that a plurality of flow members and heating members are disposed in rows in the direction of travel of the web, the flow members and the heating members alternating with one another in close succession.

20. A device according to claim 16, characterized in that a plurality of flow members and cooling members are disposed in rows in the direction of travel of the web, the flow members and the heating members alternating with one another in close succession.

21. A method of operating a drier comprising the steps of:

(a) blowing a gaseous or liquid material at an acute approach flow angle on to the surfaces of a plurality of flow members such that the gaseous or liquid material impinges on the surfaces of the flow members and is converted into wall jets;

(b) floatably guiding a web of material at a distance from said flow members;

(c) supplying a quantity of fresh air, at elevated pressure and in a volume such as is necessary to absorb volatile substances given off by the web of material during drying; and (d) removing from the drier, a quantity of outgoing air corresponding to the quantity of fresh air supplied.

22. A device for floatably guiding webs of material, comprising a plurality of elongate flow members, disposed at right angles to the moving direction of the web and spaced from each other and having a surface curved convexly on the web side, and individual nozzles which are disposed in rows and spaced from each other on at least one of the two longitudinal edges of the flow member and by means of which a gaseous or liquid medium can be blown in between the flow member and the web, characterized in that the nozzles take the form of free jet nozzles which are disposed at a distance from the flow members and are so directed at an acute approach flow angle and shallowly at the surface of the flow members that the jets emerging as free jets from the nozzles blow on the web of material only after they have impinged on the surface of the flow member and been converted into wall jets on such surface, the flow members taking the form of supply ducts for the gaseous or liquid medium and bearing the nozzles which are associated with the adjacent flow members.

23. A device according to claim 22, characterized in that a discharge duct is provided between the nozzles and the flow member on the side remote from the web of material and that the discharge duct discharges into a collecting duct which is formed by the flow member.

* * * * *